United States Patent [19]

Weber et al.

[11] Patent Number: 4,896,920

[45] Date of Patent: Jan. 30, 1990

[54] DRUM-CUTTER MINING MACHINE

[75] Inventors: Karl-Heinz Weber, Witten-Heven; Siegfried Reike, Bochum, both of Fed. Rep. of Germany

[73] Assignee: Gebr. Eickhoff Maschinenfabrik u.EisengieBerei mgH, Bochum, Fed. Rep. of Germany

[21] Appl. No.: 193,773

[22] Filed: May 13, 1988

[30] Foreign Application Priority Data

May 19, 1987 [DE] Fed. Rep. of Germany ..... 371668

[51] Int. Cl.[4] ..... E21C 29/02

[52] U.S. Cl. ..... 299/42; 299/43; 310/54

[58] Field of Search ..... 299/42, 34, 43, 18; 310/54, 83

[56] References Cited

U.S. PATENT DOCUMENTS

| | | | |
|---|---|---|---|
| 3,567,975 | 3/1971 | Biesack | 310/54 |
| 3,594,043 | 7/1971 | Weber et al. | 299/42 |
| 4,097,091 | 6/1978 | Knorr | 299/43 X |
| 4,435,018 | 3/1984 | Parrott | 299/43 |
| 4,516,044 | 5/1985 | Bone | 310/54 X |

FOREIGN PATENT DOCUMENTS

| | | | |
|---|---|---|---|
| 2721937 | 11/1978 | Fed. Rep. of Germany | 299/42 |
| 2732275 | 2/1979 | Fed. Rep. of Germany . | |
| 3109957 | 9/1982 | Fed. Rep. of Germany . | |
| 1208224 | 1/1986 | U.S.S.R. | 299/42 |

*Primary Examiner*—Stephen J. Novosad
*Assistant Examiner*—David J. Bagnell
*Attorney, Agent, or Firm*—Clifford A. Poff

[57] ABSTRACT

A drum-cutter mining machine for longwall mining operations which is adaptable for use upon longwall conveyor systems having rack structures positioned on either, or both, sides thereof. Drive motors are removably supported in a capstan housing of the mining machine, and positioned such that rotating shafts thereof extend toward either or both sides of the mining machine. Drive wheels coupled to the rotating shafts through reduction gears engage with the rack structures to allow translation of the machine therealong. When the mining machine is to be utilized on a longwall conveyor system having an alternate rack structure position, the drive motors may be removed, reoriented, reinserted into the capstan housing, and the drive wheels may be repositioned to allow operation of the mining machine.

15 Claims, 2 Drawing Sheets

DRUM-CUTTER MINING MACHINE

BACKGROUND OF THE INVENTION

1. Field of the Invention

The present invention relates generally to a drum-cutter mining machine utilized in longwall mining operations, and, more particularly, to a drum-cutter mining machine which is adaptable for use upon rack structures positioned at either side of a longwall conveyor.

2. Description of the Prior Art

Underground mining operations which involve longwall mining procedures typically utilize electrically powdered drum-cutter mining machines. A drum-cutter mining machine, also referred to as a shearer loader, is positioned proximate to a mine wall, whereat a mineral is sheared from the mine wall face. The drum-cutter mining machine includes at least one, and usually two, circular cutting drums extending from opposite ends of the minimg machine. A first cutting drum, the leading cutting drum, extends at an upwardly projecting angle from the drum-cutter mining machine. The second cutting drum, the trailing cutting drum, extends at a downwardly extending angle from the drum-cutter mining machine. During cutting operations, the leading cutting drum shears a first portion of the mine wall, and the trailing cutting drum shears a second portion of the mine wall. Translation of the mining machine along the mine wall is permitted on a rack structure, or chain, which extends along the face of the mine wall. A drive wheel of the mining machine meshingly engages with the rack to allow translation of the mining machine therealong. One such drum-cutter mining machine is disclosed in West German Patent No. DE-OS 27 32 275. The mining machine disclosed therein contains two drive motors which are positioned to have lengthwise dimensions substantially perpendicular to the lengthwise direction of the rack, and also, therefore, perpendicular to the direction of travel of the mining machine. The drive motors are connected through reduction gears, such as planetary gears, to driving wheels which engage with the rack causing translation of the mining machine therealong. However, the disclosed mining machine may only be driven on a rack which is affixed to the coal face side of a longwall conveyor. The mining machine may not be used in longwall mining operations in which the rack is affixed to the goaf side of the longwall conveyor.

The drive motor utilized by the mining machine may be similar to the asychronous short-circuited rotor electrical motor, steplessly controlled by frequency conversion disclosed in "Longwall Face Machine" Type SEM 235, of Westfalia Lunen.

Also disclosed in the prior art is West Germany Patent DE-OS 31 09 957 which discloses mining machines which are translated along a mine wall face upon two racks. The racks are situated on opposite sides of the longwall conveyor, and drive wheels of the mining machine engage with the respective racks.

Because of the differing positions of rack structures (i.e., positioned on either the coal-face side, or the goaf side of the longwall conveyor), the mining machines heretofore constructed have been designed for use on a specific rack arrangement. The use of a drum-cutter mining machine, once constructed, in conjunction with a different type of rack structure is not possible, or if possible, is only made so after complicated reconstruction of the mining machine.

It is therefore the object of the present invention to provide a drum-cutter mining machine which is adaptable for use with rack structures positioned on either, or both, sides of a longwall conveyor.

SUMMARY OF THE INVENTION

In accordance with the present invention, a drum-cutter mining machine used in longwall mining operations in conjunction with a rack structure, or other means to allow translation, positioned along side a longwall conveyor is disclosed. The mining machine includes a machine body, a capstan housing mounted upon the macine body, wherein the capstan housing upon the machine body, wherein the capstan housing contains a cylindrical bore extending therethrough, a drive motor means with a rotating shaft member removably positioned to extend within the bore of the capstan housing to be supported thereby such that a longitudinal axis of the drive motor means extends at an angle to the direction of translation of the rack, gear means rotatably coupled to the rotating shaft, and drive wheel means positioned to meshingly engage with the gear means and to the rack to allow translation of the mining machine therealong.

Beccause of the cylindrical shape of the bore of the capstan housing, the drive motor means is capable of being removed, its orientation reversed, and then reinserted in its reversed position within the bore of the capstan housing, such that, depending upon the position of the rack structure, the rotating shaft of the drive motor means, and the gear means rotataby coupled thereto, may be positioned either at a coal-face side of the mining machine, or, be positioned at a goaf side of the mining machine. Also, by such a configuration, it is clear that the motor means is capable of being inserted from one side or the other of the capstan housing bore.

In an alternative embodiment of the present invention, the drive motor means is constructed such that the rotating shaft member extends from both ends of the drive motor means, and a first gear is rotatably coupled to a first end of the rotating shaft, and a second gear is rotatably coupled to a second end of the rotating shaft, to thereby allow drive wheels to engage with racks positioned on both sides of the longwall conveyor.

The drive motor means may, for example, be comprised of a three-phase current, short circuited rotor electric motor.

The drive motor means and the gear means may also comprise a geared motor to thereby form a single structural unit centered in the bore of the capstan housing. An adjustable frequency convertor may further be positioned upon the machine body, wherein the frequency convertor is coupled in-line between the electrical power supply and the drive motor means to allow the speed of the drive motor means to be steplessly adjusted. The electrical coupling to the drive motor means may occur at a closable circumferential orifice positioned at a bore of a capstan housing.

In applications in which the rack structure is positioned on one, or the other, side of the longwall conveyor, the bore extending through the capstan housing may be sealed at a first end thereof by a cover, a may be sealed at a second end thereof by the gear means.

The mining machine may further include a cylindrical jacket positioned to extend through the cylindrical bore of the capstan housing, wherein the cylindrical jacket contains a helically extending channel on the surface thereof, and a cylindrical sleeve member surrounding the jacket such that the helically extending channel forms a passageway to allow a coolant fluid to flow therethrough.

In the preferred embodiment, the capstan housing includes a first and a second bore extending therethrough to allow a first and a second drive motor to be positioned to extend through the first and second bore, respectively.

BRIEF DESCRIPTION OF THE DRAWINGS

The present invention will be better understood when read in light of the accompanying drawings in which.

DESCRIPTION OF THE PREFERRED EMBODIMENT

Figure 1:
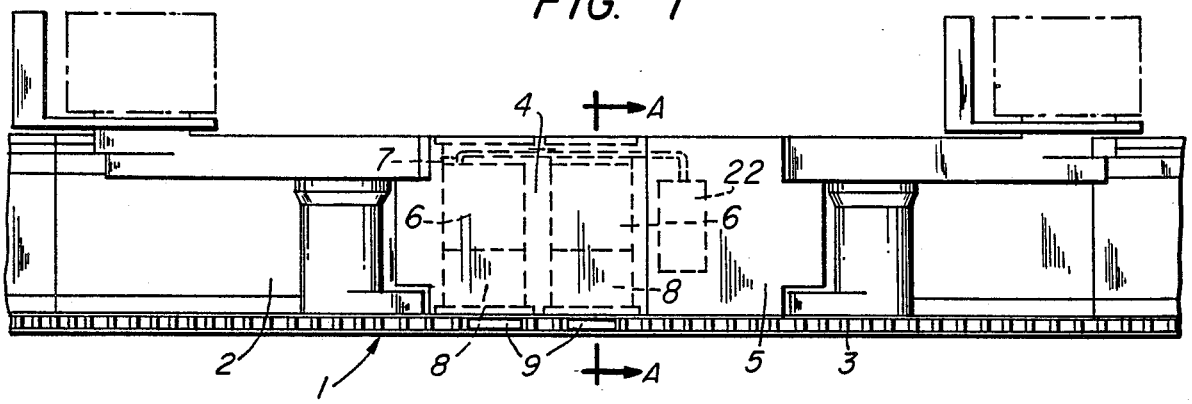
FIG. 1 illustrates a plan view of the drum-cutter mining machine of the present invention in which the mining machine is adapted for use with a rack structure positioned at the goaf side of a longwall conveyor.

Referring to the plan view of FIG. 1, there is illustrated the drum-cutter mining machine of the present invention, referred to generally by reference numeral 1. Mining machine 1 is operated in conjunction with a longwall conveyor means 2, and may be translated along a rack 3 which is positioned on the goaf side of the longwall conveyor means 2. Mining machine 1 includes a capstan housing 4, and is supplied electrical power at energy distribution system 5 from an electrical cable, not shown. Energy distribution system 5 distributes electrical power to the cutting drums and to the capstan housing.

In the preferred embodiment of FIG. 1, capstan housing 4 is equipped with two drive motors 6 which are positioned to extend at angles perpendicular to the lengthwise direction of the longwall conveyor means 2. Each drive motor 6 is inserted to extend through cylindrical bores 7 which extend through the entire width of the capstan housing 4 to thereby support the drive motors 6. Coupled to the rotating shafts of the drive motors 6 are reduction gears 8 which meshingly engage with drive wheels 9. Drive wheels 9, in turn, engage with the rack 3 to allow translation of the mining machine 1 therealong.

Figure 2:
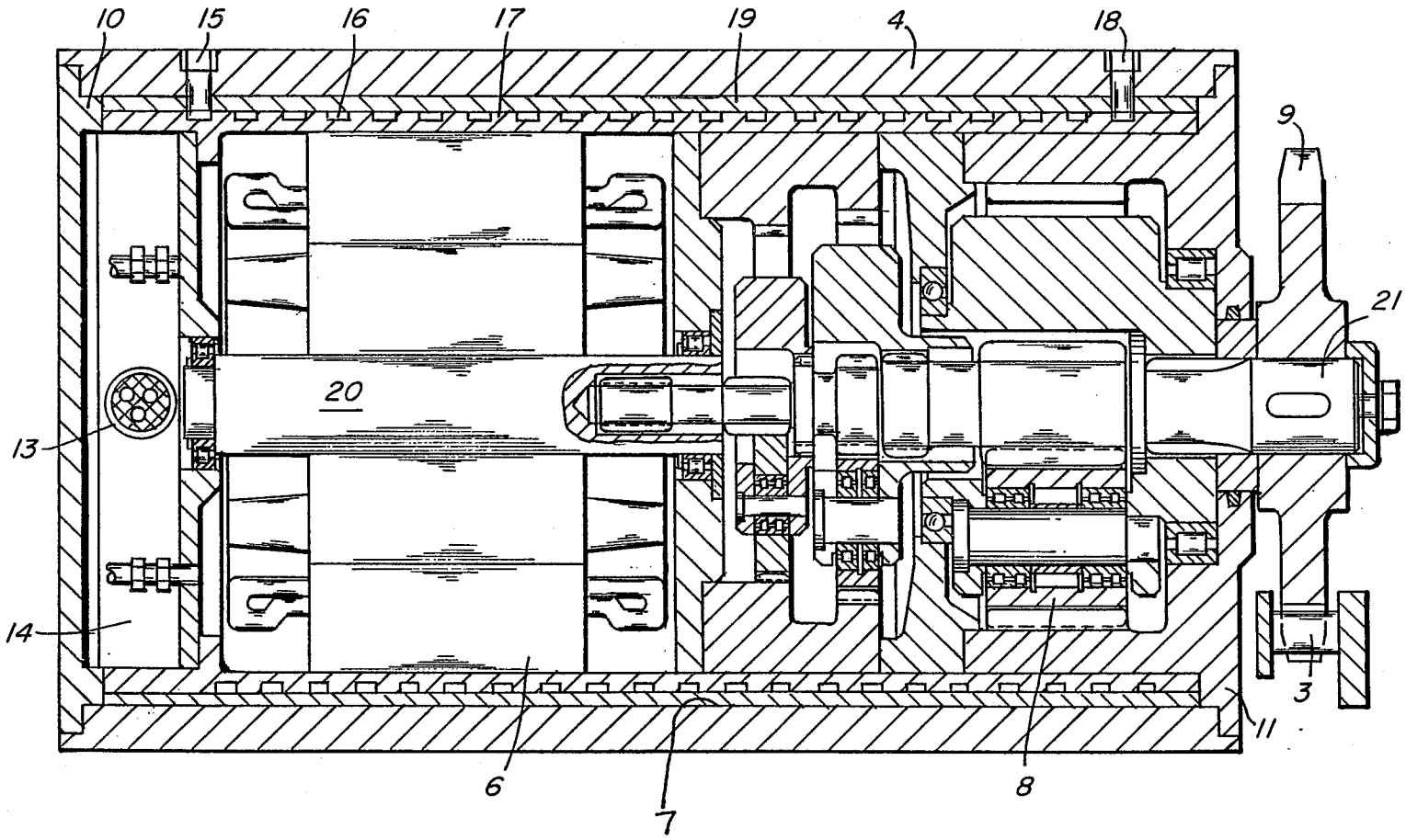
FIG. 2 is a sectional view of the drum-cutter mining machine of FIG. 1 taken along line A—A of FIG. 1.

Preferably, and as illustrated in the sectional view of FIG. 2, which shows a cross-section of one bore 7 of the capstan housing 4, first end of the bore 7 is enclosed by cover 10. A second end of the bore 7 is enclosed by gearing flange 11.

As is shown in FIG. 2, the diameters of cover 10 and gearing flange 11 are the same so that the cover 10 and gearing flange 11 are adaptable to close either end of cylindrical bore 7. In the embodiment of FIG. 1 in which rack 3 is positioned on the goaf side of the longwall conveyor, cover 10 encloses the end of the bore 7 on the coal-face side of the mining machine 1, and, gearing flange 11 sealed the end of the bore 7 on the goaf side of the mining machine 1. In this manner, drive motors 6 and the reduction gears 8 coupled thereto may be secured in the respective bores 7, and are protected from the environment of the mining area.

As illustrated in the sectional view of the preferred embodiment of FIG. 2, the drive motor 6 and reduction gear 8 form a single structural unit and are constructed as a geared motor to allow centering of the unit in the bore 7. It is, of course, alternately possible to utilize a drive motor 6 and reduction gear 8 which are separte structural units, independent of each other, but coupled so that the rotary movement of the drive motor 6 is transmitted through discrete reduction gear 8 to driving wheel 9 of the mining machine 1 wherein the drive wheel 9 engages with the rack 3.

In the preferred embodiment of FIG. 2, reduction gear 8 is a planetary gear, and together with drive motor 6, may be inserted into the bore 7 from either side of the capstan housing 4.

Figure 4:
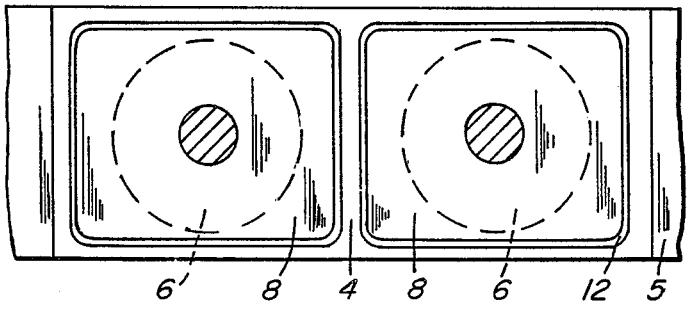
FIG. 4 is a partial view of a further embodiment of the drum-cutter mining machine of the present invention.

Referring now to the partial view of FIG. 4, there is illustrated an alternate construction of the capstan housing 4. In this construction, the bores 7 open at both ends thereof into cavities 12 formed in the side walls of the capstan housing 4. This results in the bores 7 having diameters at the end portions thereof, i.e. cavities 12, of greater magnitudes than the diameter of the bores 7 along the length thereof. The embodiment of FIG. 4 allows the reduction gears 8, to have dimensions corresponding to the dimensions of cavities 12 at the end portions of the bores.

As mentioned previously, drive motors 6 are supplied with electrical power from energy distribution system 5. Because energy distribution system 5 may be positioned at either end of the mining machine 1, depending upon the construction of the mining machine 1, bores 7 have positioned at both sides of a diameter thereof with diametrically opposite closeable circumferential orifices 13. Electrical connection between energy distribution means 5 and a respective drive motor 6 inside a connection chamber space 14 may be produced through connection to either of the circumferential orifices 13.

To prevent overheating of the drive motors 6 and reduction gears 8, a coolant system is further provided. The coolant system utilizes coolant water which is supplied through supply pipe 15 to the bores 7 of the capstan housing 4.

As is clearly shown in FIG. 2, the coolant system includes a cylindrical jacket 17 which extends substantially the entire length of bore 7 and surrounds both the motor 6 and the reduction gears 8. A helically extending coolant channel 16 is formed on the outer surface of cylindrical jacket 17 and extends substantially the entire length of jacket 17. Coolant channel 16 thus provides a path for the flow of coolant water supplied by the supply pipe 15 located at a first end of the channel 16. Outflow pipe 18 is coupled at an opposite end of channel 16 to carry away the coolant water. Sleeve 19 surrounds and encloses jacket 17 to thereby seal the coolant channel 16, forming an enclosed passageway thereby. Jacket 17 and sleeve 19 are of dimensions to allow positioning in the bores 7 of the capstan housing 4, and also to allow drive motors 6 to be positioned inside of the jacket 17. By this construction, the coolant system provides direct and efficient cooling of both the drive motors 6 and the reduction gears 8.

In the preferred embodiment, drive motors 6 are three-phase current, short-circuited rotor electric motors which, as illustrated in FIG. 2, transmit rotary movement of a rotating armature shaft 20 having a driving shaft butt 21 thereof to multi-step planetary gears 8, which meshingly engage with driving wheel 9 which, again in turn engages in the toothing of rack 3.

Figure 3:
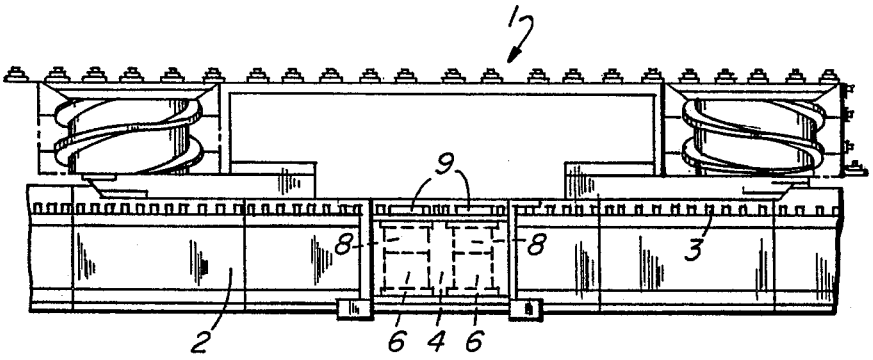
FIG. 3 is a plan view of the drum-cutter mining machine of the present invention in which the mining machine is positioned at the coal-face side of a longwall conveyor.

Referring again to the plan view of FIG. 1, mining machine 1 preferably further includes frequency convertor 22, which may, for example, be a steplessly adjustable transistor frequency convertor. Frequency convertor 22 is connected in-line with the electrical cable supplying electrical pwoer to the mining machine (not shown) and the motor 6 to allow the rotation speed of the drive motor 6 to be steplessly increased or decreased. By a suitable selection of the frequency of operation of the drive motor 6, smaller dimensioned motors may be utilized as the drive motor 6. Small drive motors 6 are advantageous in that smaller capstan housings 4 may be utilized. In such a construction, the capstan housing 4 may be positioned underneath, or as illustrated in FIG. 3, beside the machine body, thereby allowing the mining machine 1 to be of a smaller length.

Because the drive motors 6 are reversibly positionable in the bores 7 of the capstan housing 4, the mining machine 1 may be adapted for use with longwall conveyors having racks 3 positioned on either, or both, sides of the conveyor 2.

To adapt the mining machine 1 to allow use with a longwall conveyor 2 having rack 3 positioned on either side of the conveyor 2, the drive motor 6 need only to be removed from the bores 7 of capstan housing 4, the orientations thereof reversed, repositioned within the bores 7 of the capstan housing 4, and recoupled to reduction gears 8.

In an alternate embodiment, drive motor 6 of the capstan housing 4 may be equipped at both ends thereof with a rotating output shaft butt, or the output shaft of the drive motor 6 may have at both ends thereof a blind bore in which the reduction gear 8 engages with a driving shaft butt, which may be constructed as a multiple spline shaft, thereby obviating the need to reverse the orientation of the drive motors 6.

While the present invention has been described in connection with the preferred embodiments shown in the various figures, it is to be understood that other similar embodiments may be used or modifications and additions may be made to the described embodiment for performing the same functions of the present invention without deviating therefrom. Therefore, the present invention should not be limited to any single embodiment but rather construed in breadth and scope in accordance with the recitation of the appended claims.

What is claimed is:

1. A drum-cutter mining machine for use in longwall mining operations, said mining machine being translatable along a longwall conveyor having a conveyance means extending therealong, said mining machine comprising:

a machine body;

a capstan housing mounted upon the machine body, said capstan housing containing at least one bore extending therethrough;

drive motor means having a rotating shaft means, said drive motor means and said shaft means being positioned in said at least one bore to extend perpendicular to the direction of translational movement of the mining machine along said longwall conveyor;

gear means rotatably coupled to the rotating shaft means; and drive wheel means connected with said gear means, said drive wheel means being engageable with said conveyor means to cause translation of the mining machine along said longwall conveyor, said drive motor means being removably and operational in either of reversible positions in said at least one bore.

2. The machine of claim 1, wherein said at least one bore is cylindrical.

3. The machine of claim 1, wherein said motor means is insertable from either a first end or a second end of said at least one bore.

4. The machine of claim 1, wherein said drive motor means, said rotating shaft means and the gear means rotatably coupled thereto are positioned at a coal-face side of said conveyance means.

5. The machine of claim 1, wherein said drive motor means, said rotating shaft means and the gear means rotatably coupled thereto are positioned at a goaf side of said conveyance means.

6. The machine of claim 1, wherein said at least one bore extending through the capstan housing is sealed at a first end thereof by a cover, and is sealed at a second end thereof by the gear means.

7. The machine of claim 1, wherein said drive motor means and said gear means comprise a geared motor to form a single structural unit to facilitate centering thereof in said at least one bore of the capstan housing.

8. The machine of claim 1 further including an adjustable frequency convertor positioned upon the machine boyd, said frequency convertor positioned upon the machine body, said frequency convertor functioning to allow the speed of the drive mtoro means to be adjusted.

9. The machine of claim 8 wherein said frequency convertor is electrically coupled to the drive motor means at a closable circumferential orifice positioned in the bore of the capstan housing.

10. The machine of claim 1 wherein said capstan housing includes a first bore and a second bore extending therethrough.

11. The machine of claim 10 wherein said drive motor means includes a first drive motor and a second drive motor for extending through the first bore and the second bore, respectively.

12. The machine of claim 11, wherein the first and the second drive motor means extend in the same direction through said first and second bores, respectively.

13. The machine of claim 11, wherein the first and second drive motors extend in opposite directions through said first and second bores, respectively.

14. A drum-cutter mining machine for use in longwall mining operations, said mining machine being translatable along a conveyance means extending along a longwall conveyor, said mining machine comprising;

a machine body;

a capstan housing mounted upon the machine body, said capstan housing containing at least one bore extending therethrough;

drive motor means having a rotating shaft means, said drive motor means and said shaft means being positioned in said at least one bore to extend perpendicular to the direction of translation of the mining machine along said longwall conveyro;

gear means rotatably coupled to the rotating shaft means;

drive wheel means driven by said gear means, said drive wheel means being engagable with said conveyance means to cause translation of the mining machine therealong;

cylindrical jacket means positioned to extend through said at least one bore in said capstan housing, said cylindrical jacket means extending substantially the entire length of said at least one bore so as to substantially surround said driven motor means and said gear means;

channel means formed in an outer surface of said cylindrical jacket means, said channel means extending substantially the entire length of said cylindrical jacket means; and sleeve means surrounding the jacket means such that the channel means forms a passageway to allow coolant to flow therethrough, the coolant passageway formed by the channel means being of sufficient length to surround both the drive motor means and the gear means in order to provide direct cooling to both the drive motor means and the gear means, wherein said drive motor means is removeably and reversibly positionable in said at least one bore.

15. A drum-cutter mining machine for use in longwall mining operations, the mining machine beng translatable along a conveyance means positioned alongside a longwall conveyor, said mining machine comprising:

a machine body;

a capstan housing mounted upon the machine body, said capstan housing containing at least one bore extending therethrough;

drive motor means having a rotating shaft means, said drive motor means and said shaft means being positioned in said at leats one bore to extend perpendicular to the direction of translation of the mining machine along said longwall conveyor;

gear means rotatably coupled to the rotating shaft means;

drive wheel means connected with said gear means, said drive wheel means being engagable with said conveyance means to cause translation of the mining machine therealong;

cylindrical jacket means positioned to extend through said at least one bore in said capstan housing, said cylindrical jacket means extending substantially the entire length of said at least one bore so as to substantially surround said drive motor means and said gear means;

helically extending channel means formed in an outer surface of said cylindrical jacket means, said helically extending channel extending substantially the entire length of said cylindrical jacket means; and sleeve means surrounding the jacket means such that the helically extending channel means forms a passageway to allow coolant to flow therethrough, whereby the coolant passageway formed by the helically extending channel is of sufficient length to surround both the drive motor means and the gear means in order to provide direct cooling to both the drive motor means and the gear means, and wherein said drive motor means is removably and reversibly positionable in said at least one bore.

* * * * *